US009938124B2

(12) United States Patent
Robert

(10) Patent No.: US 9,938,124 B2
(45) Date of Patent: Apr. 10, 2018

(54) TELESCOPIC HANDLING DEVICE COMPRISING AT LEAST TWO ELEMENTS MOUNTED SO AS TO SLIDE RELATIVE TO ONE ANOTHER

(71) Applicant: MANITOU BF, Ancenis (FR)

(72) Inventor: Jean-Michel Robert, Saint Herblon (FR)

(73) Assignee: MANITOU BF, Ancenis (FR)

( * ) Notice: Subject to any disclaimer, the term of this patent is extended or adjusted under 35 U.S.C. 154(b) by 0 days.

(21) Appl. No.: 14/819,542

(22) Filed: Aug. 6, 2015

(65) Prior Publication Data

US 2016/0039650 A1 Feb. 11, 2016

(30) Foreign Application Priority Data

Aug. 7, 2014 (FR) ..... 14 57675

(51) Int. Cl.

| | |
|---|---|
| ***B66C 23/04*** | (2006.01) |
| ***B66F 13/00*** | (2006.01) |
| ***B66C 23/70*** | (2006.01) |
| ***B66F 9/065*** | (2006.01) |
| ***B66F 11/04*** | (2006.01) |

(52) U.S. Cl.

CPC ..... *B66F 13/00* (2013.01); *B66C 23/701* (2013.01); *B66C 23/707* (2013.01); *B66F 9/0655* (2013.01); *B66F 11/046* (2013.01)

(58) Field of Classification Search

CPC ..... B66C 23/70; B66C 23/701; B21C 37/08; B66F 13/00; B66F 11/046; B66F 9/0655

USPC ..... 52/118; 212/350

See application file for complete search history.

(56) References Cited

U.S. PATENT DOCUMENTS

| | | | | |
|---|---|---|---|---|
| 4,478,014 A * | 10/1984 | Poock | B66C 23/701 212/350 |
| 6,108,985 A * | 8/2000 | Paschke | B66C 23/707 212/348 |
| 8,549,812 B1 * | 10/2013 | Peng | E04B 1/34305 212/348 |
| 2006/0219650 A1 * | 10/2006 | Gokita | B66C 23/707 212/350 |

FOREIGN PATENT DOCUMENTS

| | | | | |
|---|---|---|---|---|
| DE | 2303644 A1 * | 11/1974 | B66C 23/707 |
| DE | 202011100957 U1 | 3/2011 | |
| FR | 2759687 A1 * | 8/1998 | B66C 23/707 |
| FR | 2790538 A1 * | 9/2000 | B66C 23/701 |
| FR | EP 1955975 A1 * | 8/2008 | B66C 23/707 |
| WO | WO2011065900 | 6/2011 | |
| WO | WO2013007050 | 1/2013 | |

OTHER PUBLICATIONS

Search Report dated Nov. 30, 2015.
Joint FR and EP Search Report dated Apr. 9, 20151(FR) and Dec. 7, 2015(EP).

* cited by examiner

*Primary Examiner* — Beth Stephan
(74) *Attorney, Agent, or Firm* — IPSILON USA, LLP

(57) ABSTRACT

A telescopic handling device includes at least two elements (1, 2) mounted so as to slide relative to one another with interposition of sliding shoes (3, 4). The device includes thinner holding elements (5, 6) for the sliding shoes so as to limit the separation between two sliding elements to the thickness of the interposed sliding shoes (3, 4).

23 Claims, 2 Drawing Sheets

TELESCOPIC HANDLING DEVICE COMPRISING AT LEAST TWO ELEMENTS MOUNTED SO AS TO SLIDE RELATIVE TO ONE ANOTHER

FIELD OF THE INVENTION

The invention relates to a telescopic handling device, comprising at least two elements mounted so as to slide relative to one another with interposition of sliding shoes.

The invention is particularly useful in its application to telescopic-arm handling trucks or to telescopic-arm basket cranes, as well as any other machine comprising a telescopic handling device.

BACKGROUND OF THE INVENTION

Telescopic-arm handling trucks comprising sliding shoes with screwed inserts are known. In order to fix these sliding shoes, it is necessary to pierce the structures which are to receive them, then to shim by means of additional parts.

This arrangement requires the use of screwed sliding shoes with a large number of stacked thickness shims.

This arrangement risks weakening the strength and the reliability of each screwed assembly comprising a sliding shoe and a thickness shim.

Also known are telescopic-arm handling trucks having sliding shoes encased in positioning and holding cages. However, the shape and bulkiness of the holding cages depend on the shape of the telescopic arm elements.

Document EP 1 955 975 B1 describes a telescopic handling device comprising at least two elements of essentially rectangular cross section, mounted so as to slide relative to one another with interposition of sliding shoes. The sliding shoes are mounted in cages provided with means for securing to a sliding element. The cages of sliding shoes comprise means for securing to a flange or to an endstop of a sliding element of the telescopic arm. The shoe securing means is generally sandwiched between the flange of a sliding element and a counter-flange.

Although the provisions of EP 1 955 975 B1 make it possible to use fewer securing screws, the shape and bulkiness of the positioning and holding cages limit the reduction of the separation between the sliding tubes of the telescopic arm.

SUMMARY OF THE INVENTION

A first object of the invention is to improve the known prior art, by making the telescopic handling device more compact and by reducing the separation between elements mounted so as to slide relative to one another of a telescopic handling device.

A second object of the invention is to provide a new telescopic handling device which can be applied to various shapes of sliding elements.

A third object of the invention is to allow the use of sliding shoes whose thickness matches the separation between the sliding tubes of the telescopic arm, thus making it easier to replace worn sliding shoes.

A fourth object of the invention is to provide a new manner of mounting sliding shoes in which each sliding shoe is independent of the other sliding shoes.

A fifth object of the invention is to increase the productivity of manufacturing the telescopic handling devices, omitting the removable holding and positioning cages and permitting rapid attachment and simple replacement of the worn sliding shoes.

A sixth object of the invention is to allow greater shoe wear, up to a predetermined limit, before replacement.

The invention relates to a telescopic handling device, comprising at least two elements mounted so as to slide relative to one another with interposition of sliding shoes, the device comprising thinner means for holding the sliding shoes so as to limit the separation between two successive sliding elements to the thickness of the interposed sliding shoes, characterized in combination in that the means for holding the sliding shoes comprise tenon-shaped features and in that the sliding shoes each have a mortise-shaped feature which engages with a said tenon-shaped feature, and in that at least one sliding shoe holding means is T-shaped.

Thus, the thickness of the assembly of the holding means and of the sliding shoes is close to the thickness of the corresponding sliding shoes.

According to other alternative features of the invention:

- the bar of the T shape forms a mounting stop for a sliding shoe.
- the T shape has a stem provided with a mechanical attachment means for immobilizing a sliding shoe.
- the stem of the T shape may have a widened portion passing through the wall of a sliding element and comprising a tapped portion for attaching a holding screw.
- the device may comprise at least one flange and at least one counter-flange for holding the sliding shoes.
- the device may comprise a blocking means for preventing the sliding shoes from leaving their holding means.
- the blocking means is essentially a bracket-shaped.
- at least one holding means is mounted at least partially through the wall of a sliding element.

BRIEF DESCRIPTION OF THE DRAWINGS

The invention will be better understood by means of the following description, given by way of non-limiting example, with reference to the appended drawings, in which.

DETAILED DESCRIPTION OF THE INVENTION

With reference to FIGS. 1 to 5, identical or functionally equivalent elements are denoted by identical reference numbers.

Figure 1:
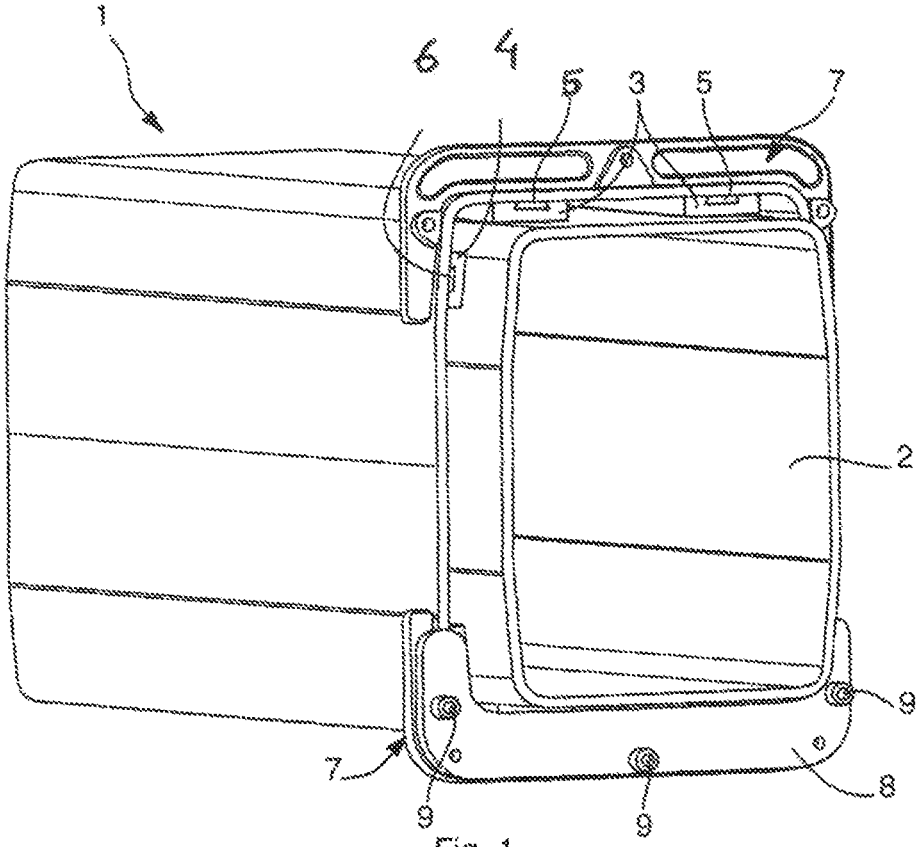
FIG. 1 shows, schematically, a front perspective view of a first telescopic handling device according to the invention.

In FIG. 1, a first telescopic handling device according to the invention comprises a larger-cross section element 1 and a smaller-cross section element 2, mounted so as to slide relative to one another with interposition of sliding shoes 3 and 4.

Sliding shoes 3 are horizontal sliding shoes.

Sliding shoes 4 are essentially vertical sliding shoes.

The larger-cross section element 1 bears, internally, these respectively horizontal and essentially vertical sliding shoes 3 and 4.

Figure 2:
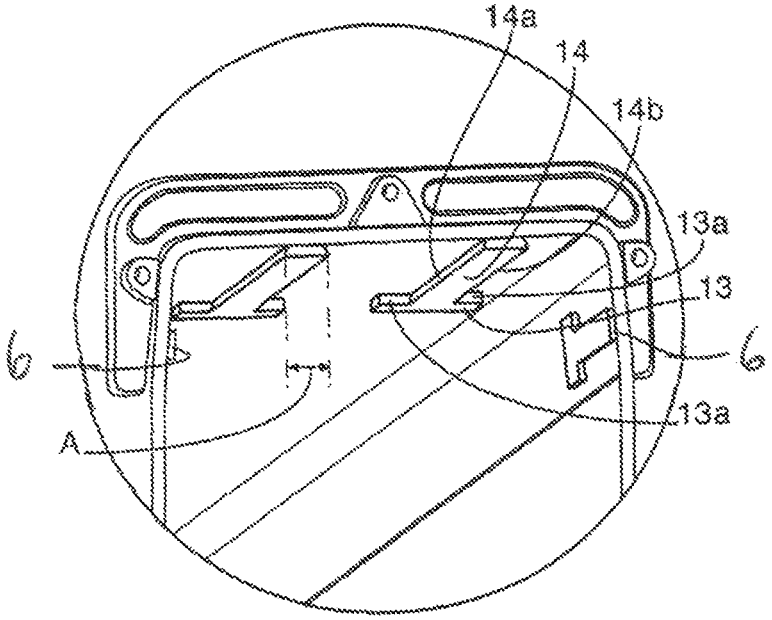
FIG. 2 shows, schematically, an enlarged detail perspective view of an element of a telescopic handling device according to the invention, bearing means for holding and mounting sliding shoes.
Figure 5:
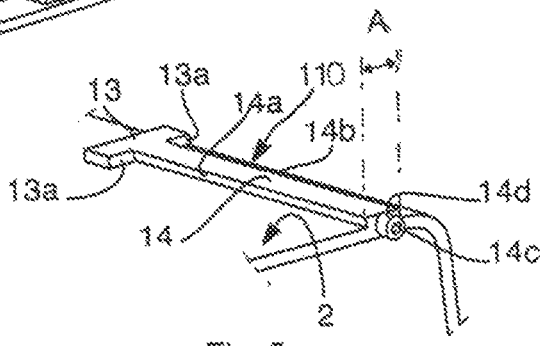
FIG. 5 shows, schematically, a partial detail perspective view of an element of a telescopic handling device according to the invention, bearing means for holding and mounting sliding shoes.

The horizontal sliding shoes 3 are generally larger than the essentially vertical sliding shoes 4, while being similar in shape, as described in FIGS. 2 and 5.

The element 1 comprises an end flange 7 provided with three tapped portions designed to receive screws 9 passing through orifices of a counter-flange 8 for retaining sliding shoes 3 and 4 on holding means 5 and 6.

The lower rim of the counter-flange 8 blocks the sliding shoes 3 and 4 on their holding means 5 and 6 when elements 1 and 2 slide with respect to one another in the direction of extension of the telescope, while the base of the holding means 5 and 6 is arranged in abutment so as to block the sliding shoes 3 and 4 in the direction of retraction of the telescope.

Removing the counter-flange 8 also makes it easier to replace the worn shoes 3 and 4 or to periodically inspect and lubricate them.

The telescopic handling device according to the invention also comprises at least one smaller-cross section element mounted so as to slide in a relative manner with interposition of sliding shoes 3 and 4 in the larger-cross section element 1.

FIG. 2 shows at least one sliding shoe holding means 5.

Each sliding shoe holding means 5 is T-shaped, with a bar 13 oriented transversely to the sliding element and a straight part oriented longitudinally in the telescoping direction of the sliding element.

The bar 13 of the T shape forms a mounting stop for a sliding shoe, so as to prevent it from sliding too far into the corresponding sliding element.

The straight part or stem 14 of the holding member 5 has a tenon-shaped feature with faces 14*a*, 14*b* oriented so as to form an opening angle A between 100 and 140 degrees.

The faces 13*a* of the bar 13 of the T shape of the holding means 5 are preferably orthogonal faces essentially perpendicular to the sliding element 1.

The T shape of the holding means 5 is preferably attached by welding the distal side of the bar 13 of the T shape to the wall of the fixed element 1, and welding the proximal side of the straight part 14.

The invention described with reference to particular embodiments is in no way limited thereto, but rather covers any form variant and any modification of realization within the scope of the appended claims.

Figure 3:
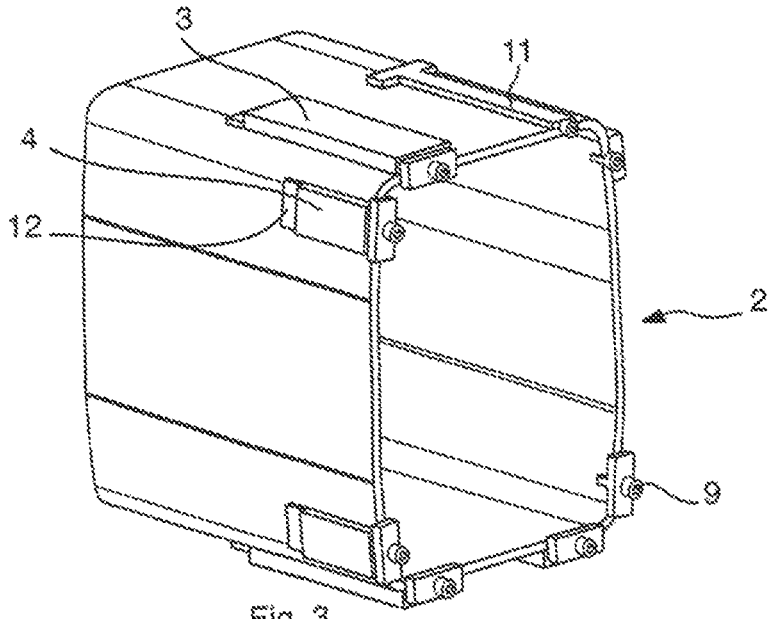
FIG. 3 shows, schematically, a perspective view of another element of a telescopic handling device according to the invention, bearing means for holding and mounting sliding shoes.
Figure 4:
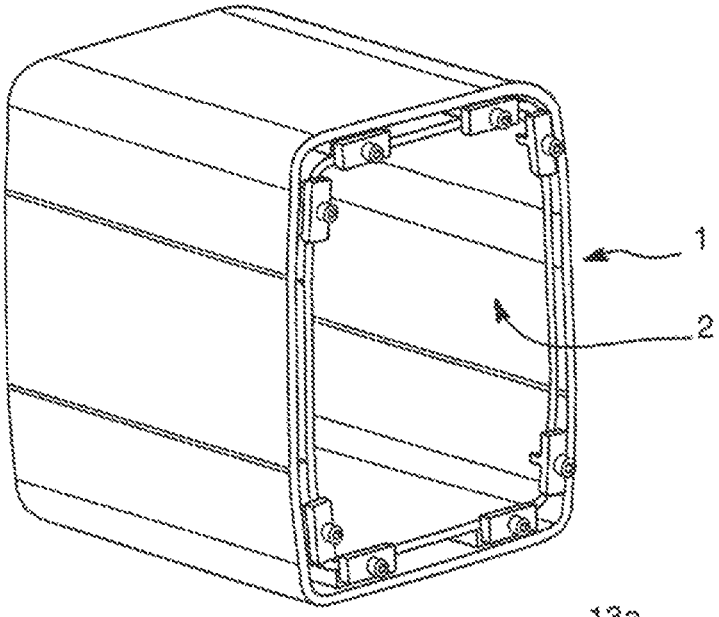
FIG. 4 shows, schematically, a perspective view of a second telescopic handling device according to the invention.

FIGS. 3 and 4 show a rear view of a second telescopic handling device according to the invention, with FIG. 3 omitting the larger-cross section sliding element 1, which is not shown for reasons of clarity.

The smaller-cross section element 2 bears, externally, respectively horizontal and essentially vertical sliding shoes 3 and 4.

The sliding shoes 3 and 4 are mounted on tenon-shaped features of supports 11 and 12 and each have, to that end, a mortise-shaped feature destined to engage with the tenon-shaped feature of the corresponding support 11 or 12.

In order to avoid the sliding shoe 3 or the sliding shoe 4 coming out, provision is made to block the proximal face of the sliding shoe 3 or of the sliding shoe 4 by means of an abutment member held by all screw 9 screwed into a tapped portion of the support 11 or 12.

In this example, each of the sliding shoes 3 or des sliding shoes 4 is blocked individually.

A sliding shoe 3 and a sliding shoe 4 may also be blocked simultaneously by means of an essentially bracket-shaped feature blocking two shoes mounted with the aid of two screws 9.

This arrangement is particularly advantageous for blocking sliding shoes of a telescopic handling device similar to the device described in EP 1 955 975 B1.

FIG. 5 shows a sliding shoe holding means 110.

The sliding shoe holding means 11 is T-shaped, with a bar 13 oriented transversely to the sliding element and a straight part oriented longitudinally in the direction of telescoping of the sliding element.

The transversely oriented bar 13 of the T shape forms a mounting stop for a sliding shoe, so as to prevent it from sliding too far into the corresponding sliding element.

The straight part or stem 14 of the holding means 110 has a tenon-shaped feature with faces 14*a*, 14*b* oriented so as to form an opening angle A between 100 and 140 degrees.

The faces 13*a* of the bar 13 of the T shape of the holding means 110 are preferably orthogonal faces essentially perpendicular to the sliding element 1.

The front face of the straight part 14 of the holding means 110 has a widened opening so that is it possible to create therein a tapped portion 14*c* able to receive an attachment screw 9.

This widened part 14*d* is formed so as to prevent the shoe blocking means from rotating.

The thickness of the T shape is increased on the side of this front face of the straight part 14 and of the proximal end of the sliding element 2, so as to effect an interlayered mounting.

The T shape of the holding means 110 is preferably attached by welding the distal side of the bar 13 of the T shape to the wall of the sliding element 2, and by welding the proximal side of the straight part 14 close to the tapped portion 14*c* to the proximal end of the sliding element 2.

It may be possible to create a reverse weld beneath the thickness of the wall of the sliding member 2, to further reinforce the securing of the holding means 110 to the wall through part of which the sliding element 2 passes.

The invention described with reference to particular embodiments is in no way limited thereto, but rather covers any form variant and any modification of realization within the scope of the appended claims.

The invention claimed is:

1. A telescopic handling device comprising:

at least two elements mounted so as to slide relative to one another with interposition of sliding shoes, said at least two elements including a first element of larger-cross section and a second element of smaller cross section, the device comprising thinner means for holding the sliding shoes so as to limit the separation between the first and second elements to a thickness of the interposed sliding shoes, wherein the means for holding the sliding shoes each comprise a tenon having a trapezoid cross section, and wherein the sliding shoes each have a mortise which engages with said tenon, and at least one of the sliding shoe holding means is T-shaped.

2. The telescopic handling device according to claim 1, wherein a bar of the T shape forms a mounting stop for one of the sliding shoes.

3. The telescopic handling device according to claim 1, wherein the T shape has a stem provided with a mechanical attachment means for immobilizing one of the sliding shoes.

4. The telescopic handling device according to claim 3, wherein the stem of the T shape has a widened portion passing through a wall of one of the sliding elements and comprising a tapped portion for attaching the mechanical attachment means.

5. The telescopic handling device according to claim 1, further comprising at least one flange and at least one counter-flange for holding the sliding shoes.

6. The telescopic handling device according to claim 1, further comprising a blocking means for preventing at least one sliding shoe from leaving its holding means.

7. The telescopic handling device according to claim 6, wherein the blocking means has a feature securing two distinct shoe blocking means.

8. The telescopic handling device according to claim 1, wherein at least one holding means is mounted at least partially through the wall of one of the sliding elements.

9. The telescopic handling device according to claim 2, wherein the T shape has a stem provided with a mechanical attachment means for immobilizing one of the sliding shoes.

10. The telescopic handling device according to claim 9, wherein the stem of the T shape has a widened portion passing through a wall of one of the sliding elements and comprising a tapped portion for attaching a holding screw mechanical attachment means.

11. The telescopic handling device according to claim 2, further comprising at least one flange and at least one counter-flange for holding the sliding shoes.

12. The telescopic handling device according to claim 3, further comprising at least one flange and at least one counter-flange for holding the sliding shoes.

13. The telescopic handling device according to claim 4, further comprising at least one flange and at least one counter-flange for holding the sliding shoes.

14. The telescopic handling device according to claim 2, further comprising a blocking means for preventing at least one of the sliding shoes from leaving its holding means.

15. The telescopic handling device according to claim 3, further comprising a blocking means for preventing at least one of the sliding shoes from leaving its holding means.

16. The telescopic handling device according to claim 4, further comprising a blocking means for preventing at least one of the sliding shoes from leaving its holding means.

17. The telescopic handling device according to claim 2, wherein at least one holding means is mounted at least partially through the wall of one of the sliding elements.

18. The telescopic handling device according to claim 3, wherein at least one holding means is mounted at least partially through the wall of one of the sliding elements.

19. The telescopic handling device according to claim 4, wherein at least one holding means is mounted at least partially through a wall of one of the sliding elements.

20. The telescopic handling device according to claim 5, wherein at least one holding means is mounted at least partially through a wall of one of the sliding elements.

21. The telescopic handling device of claim 1, wherein, with said means for holding the sliding shoes being supported by one of said first and second elements; the trapezoid shaped tenon has a smaller base edge that faces an internal wall of said one of first and second elements that bears said means for holding, while a longer base edge is oriented in direction of an external wall of the other of said one of said first and second elements.

22. The telescopic handling device of claim 1, wherein said trapezoid shaped tenon presents opposite sides forming an opening angle between 100 and 140 degrees.

23. The telescopic handling device of claim 1, wherein said at least one T-shaped holding means includes a straight part oriented longitudinally in a telescoping direction of the telescopic handling device and a transversal bar that is positioned into said first element of larger cross section on which said holding means is supported so as to prevent the corresponding sliding shoe from sliding too far into said first element of larger cross section.

* * * * *